United States Patent [19]

Haug

[11] 4,228,781

[45] Oct. 21, 1980

[54] TRAMMING FIXTURE FOR POSITIONING A DRESSING WHEEL

[75] Inventor: Edward W. Haug, Rockford, Ill.

[73] Assignee: Barber-Colman Company, Rockford, Ill.

[21] Appl. No.: 10,766

[22] Filed: Feb. 9, 1979

[51] Int. Cl.[3] ..... B24B 53/06

[52] U.S. Cl. ..... 125/11 CD; 51/165.74; 125/11 TP

[58] Field of Search ..... 125/11 R, 11 TP, 11 A, 125/11 CD, 11 F; 51/125, 165.74

[56] References Cited

U.S. PATENT DOCUMENTS

| | | | |
|---|---|---|---|
| 2,600,127 | 6/1952 | Reaser | 125/11 TP |
| 3,752,143 | 8/1973 | Trochet | 125/11 A |
| 4,106,240 | 8/1978 | DeBartolo | 51/125 |

*Primary Examiner*—Harold D. Whitehead

*Attorney, Agent, or Firm*—Robert M. Hammes, Jr.

[57] ABSTRACT

A tramming fixture and method for accurately tramming in, or positioning, a dressing wheel with respect to a dressing axis of a dressing machine so that all points on the surface of the dressing wheel which contact the workpiece during dressing are equi-distant from such dressing machine axis. In accordance with this invention, the tramming fixture provides a mechanism for obtaining a measurement representative of the distance between a reference line and the point of dressing contact on the peripheral surface of the dressing wheel. By tilting or rotating the dressing wheel about the dressing axis through predetermined angles, taking corresponding distance measurements, and comparing the measurements, a determination can be made of the appropriate position adjustment required to properly locate the dressing wheel.

14 Claims, 7 Drawing Figures

TRAMMING FIXTURE FOR POSITIONING A DRESSING WHEEL

BACKGROUND OF THE INVENTION

This invention pertains to machines for dressing grinding wheels. In particular, the invention concerns a method and apparatus for accurately locating, or tramming-in, a dressing wheel in a dressing machine used for form-dressing grinding wheels. Certain grinding operations require a grinding wheel having a particular surface contour, such as grinding of form cutters. In dressing such grinding wheels it is necessary to employ a dressing machine which moves a dressing wheel in a predetermined path about the periphery of the grinding wheel so that the dressed grinding wheel has the particular contour desired. This is often referred to as form-dressing and dressing machines having such capabilities are well-known.

A typical dressing wheel has sides which taper to a rounded circumferential apex and is provided with an abrasive material, such as diamonds, on the circumferential surface which contacts the grinding wheel being dressed. In a section is taken along the diameter of the dressing wheel at the point of dressing contact (the point of contact between the dressing wheel and the grinding wheel surface being dressed) the rounded circumferential apex is preferably defined by a given transverse radius having its center lying on a diametral axis of the dressing wheel.

During the dressing operation, the dressing wheel is preferably moved along the contour of the grinding wheel in a manner which maintains the center of the transverse radius a substantially constant distance from the surface of the grinding wheel. Additionally, the dressing wheel may be rotated at the center of the transverse radius about an axis perpendicular to, and lying in a common plane with, such diametral axis. The degree of rotation is normally limited so that any point on the dressing wheel coming in contact with the surface of the grinding wheel during dressing lies on the radial surface of the apex. This insures that all points of the dressing wheel which contact the surface being dressed are equi-distant from the center of the transverse radius so that accurate dressing can be accomplished.

In the typical dressing machine, a dressing wheel fixture is provided which has an axis, hereafter referred to as the dressing axis, which is moved along the contour of the grinding wheel being dressed at a fixed distance from the surface of the grinding wheel. The dressing wheel fixture is also adapted to rotate about the dressing axis. The dressing wheel is positioned in the dressing wheel fixture in fixed relationship to the dressing axis such that its circumferential apex contacts the grinding wheel during the dressing operation. As the dressing axis is moved about the contour of the grinding wheel contact between the rotating dressing wheel and the grinding wheel dresses the grinding wheel surface. The dressing wheel fixture is normally adapted to rotate about the dressing axis in a manner which similarly rotates the dressing wheel about the dressing axis so as to avoid interference between the dressing wheel and the grinding wheel surface being dressed.

If the center of the transverse radius is offset from the dressing axis the grinding wheel will not be accurately dressed since the distance between the circumferential surface of the dressing wheel and the surface of the grinding wheel will not be maintained constant. The degree to which this offset affects dressing accuracy depends on the tolerances of a particular dressing operation. The required size of the transverse radius generally depends on the characteristics of the contour being dressed. In certain grinding operations inside angles on the contoured surface may be such that the transverse radius of the apex must be very small, for example 0.005 in., in order to prevent undesirable gouging of the surface being dressed. In such instances it may be necessary to tram-in the dressing wheel so that the center of the transverse radius is located on the dressing axis within close tolerances, such as ±0.0001 in. Further, in any situation where an accurately dressed form is required it is necessary to accurately tram the dressing wheel since the accuracy of the dressed form is directly related to the accuracy of this center location.

From the foregoing it is apparent that it is necessary to tram-in or precisely locate the dressing wheel in the dressing wheel fixture of the dressing machine so that all points on the circumferential surface of the dressing wheel which may come in contact with the grinding wheel being dressed are equi-distant from the dressing axis. This requires that the center of the transverse radius of the circumferential dressing wheel apex at the dressing contact point coincides with the dressing axis of the dressing wheel fixture. In a typical dressing wheel fixture this may be accomplished by moving adjustable cross slides in an X-Y plane perpendicular to the dressing axis.

While it may be possible to accurately position certain types of dressing wheels using conventional measuring devices while the dressing wheel is not rotating, there are situations in which the position checking must be accomplished while the dressing wheel is rotating about its center (measurement under dynamic conditions as opposed to static conditions). For instance, in certain diamond dressing wheels the transverse radius of the circumferential apex is not formed by a single diamond but rather by a plurality of diamonds spaced about the circumference of the dressing wheel whose high points define the radial profile while the dressing wheel rotates. Thus, at a given point on the circumference of the dressing wheel a complete radial surface may not be present since the transverse radius is not formed by a single diamond. In such cases static measurements used to attempt to properly locate the dressing wheel result in inaccuracies. Heretofore, it has not been possible to make such measurements dynamically using conventional measuring instruments since such instruments are necessarily destroyed when brought in contact with the rotating dressing wheel. consequently, the dressing wheels must be positioned by a trial and error method which is time consuming and often inaccurate.

Prior to the instant invention, there has long been a need for a positioning system which permits precision location of a dressing wheel under dynamic conditions as well as static conditions.

SUMMARY OF THE INVENTION

The instant invention solves the foregoing problem by providing apparatus useful in tramming-in a dressing wheel under either static or dynamic conditions so that the transverse radius of the circumferential apex of the dressing wheel lies on the dressing axis of the dressing wheel fixture of a dressing machine. According to the invention, a tramming fixture is provided which has a lever pivotally mounted for rotation about a lever axis, adjusting means located to contact the lever at a point displaced from the lever axis so as to selectively rotate the lever about the axis, and indicating means also located to contact the lever at a point displaced from the lever axis and being responsive to the rotational movement of the lever. The tramming fixture is further provided with a contact means associated and movable with the lever when the lever is rotated by the adjusting means, the contact means being displaced from the lever axis and located to contact the circumferential surface of the dressing wheel in response to rotational movement of the lever when the fixture is used in connection with a dressing machine.

In use the tramming fixture is oriented in the dressing machine such that the contacting means is proximate to the circumferential surace of the dressing wheel mounted in the dressing wheel fixture. The lever may then be rotated by the adjusting means so that the contact means moves toward the dressing wheel and when contact is made between the dressing wheel and contact means the indicating means provides a reading representative of the distance moved by the contacting means. By tilting or rotating the dressing wheel about the dressing axis through predetermined angles and performing the foregoing process readings are obtained which can be compared to determine the necessary movement of the dressing wheel in the dressing wheel fixture to make the center of the transverse radius lie substantially on the dressing axis.

The invention thus provides an apparatus which solves the existing problem described above by permitting accurate dynamic measurements for positioning a dressing wheel. Other objects and advantages as well as a more thorough understanding of the invention can be obtained from the following detailed description of the preferred embodiment taken in conjunction with the drawing figures.

DESCRIPTION OF THE PREFERRED EMBODIMENT OF THE INVENTION

Figure 1:
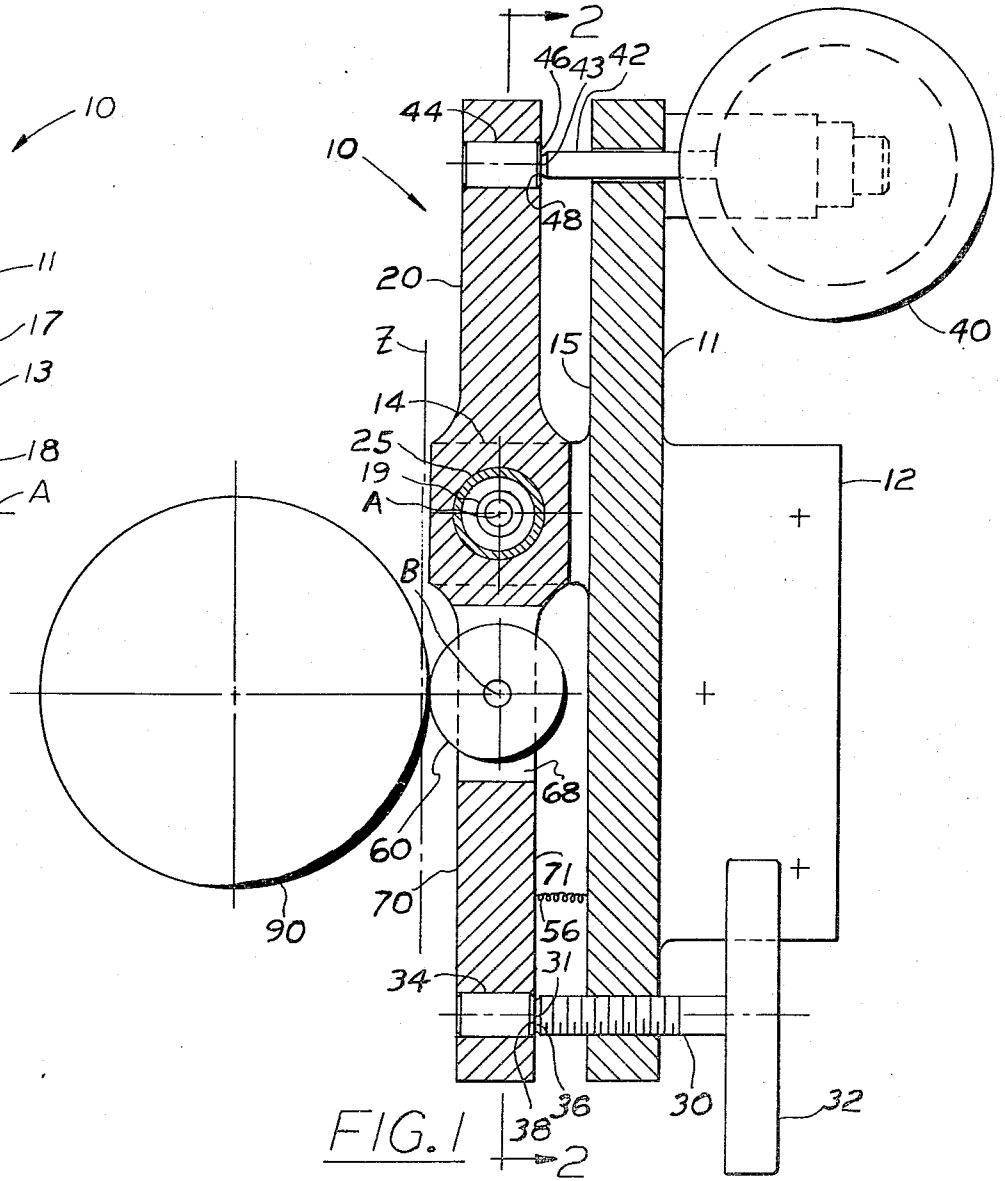
FIG. 1 is a side elevational view, partly in section, taken along line 1—1 of FIG. 3 of a preferred embodiment of a tramming fixture according to the invention.
Figure 2:
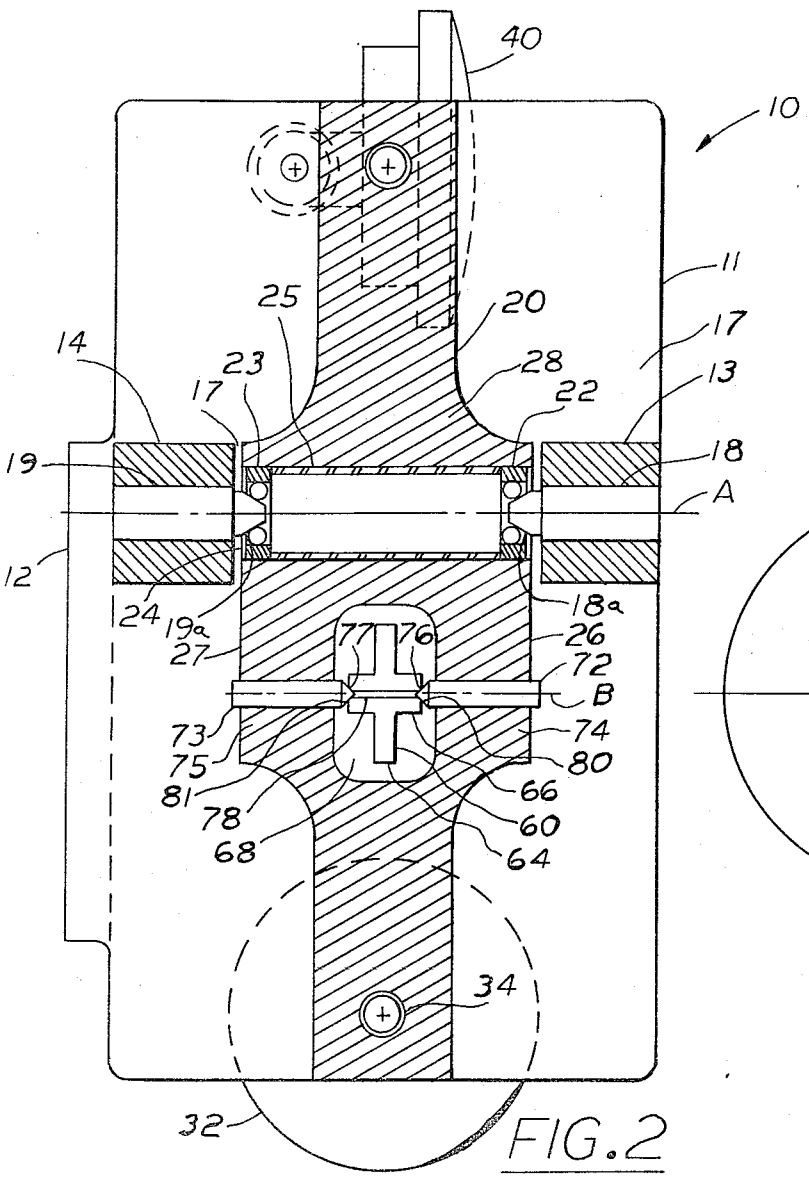
FIG. 2 is a front view of the tramming fixture of FIG. 1, partially in section, taken along the line 2—2 of FIG. 1.
Figures 3, 4, 5, 6, 7:
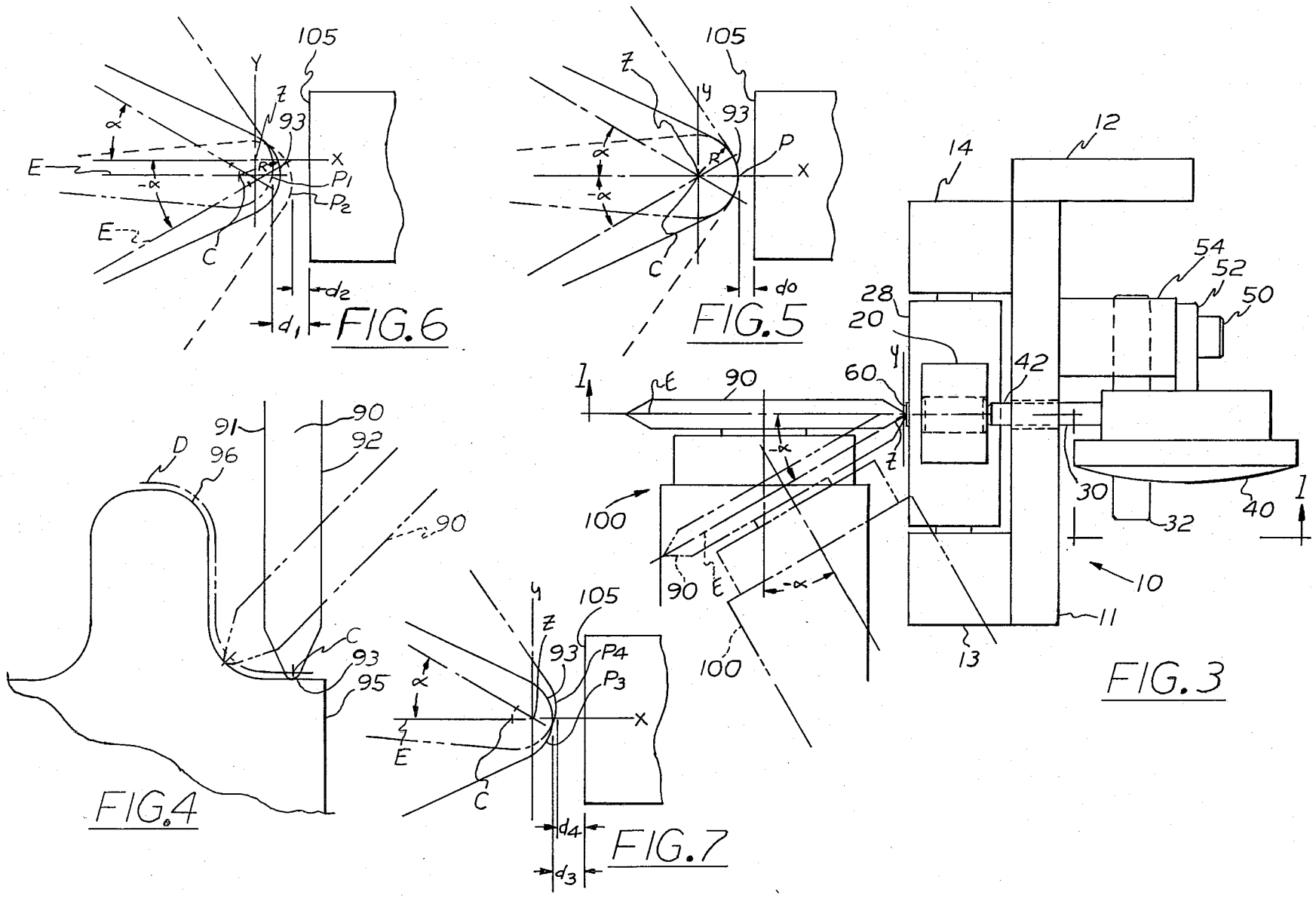
FIG. 3 is a top view of the tramming fixture shown in FIGS. 1 and 2.
FIG. 4 is a schematic illustration of the movement of a dressing wheel around a grinding wheel during a typical dressing operation.
FIG. 5 is a schematic illustration of the rounded circumferential apex of a dressing wheel in the trammed-in position.
FIG. 6 is a schematic illustration of a tramming method according to the invention.
FIG. 7 is a schematic illustration of another tramming method according to the invention.

Referring to FIGS. 1, 2 and 3, the tramming fixture generally indicated at 10 is provided with a substantially flat base 11 having a mounting flange 12 extending laterally therefrom to facilitate mounting of the tramming fixture in an appropriate position in a dressing machine (not shown). Base 11 is also provided with lugs 13, 14 protruding from a surface 15 of a medial portion 16 of base 11, lugs 13, 14 spaced apart to provide a gap 17 therebetween. Centers 18, 19 are concentrically located in lugs 13, 14 respectively to form an axis A and are provided with tapered portions **18*a*, 19*a* protruding into gap 17. Centers 18, 19 are retained in lugs 13, 14 in any suitable manner such as by press fit or an appropriate retaining cap. An elongated lever 20 is mounted in gap 17 between lugs 13, 14 on tapered portions 18*a*, 19*a* of centers 18, 19 for rotation about axis A. In order to facilitate accurate mounting, lever 20 is preferably provided with bearings 22, 23 located within bore 24 and separated by spacer 25 so as to be located proximate to sides 26, 27 of medial portion 28 of lever 20. Lever 20 is thus generally oriented along surface 16 of base 11** and is freely pivotal about axis A.

Tramming fixture 10 is also provided with adjusting means suitable for selectively moving or rotating lever 20 about axis A. In the preferred embodiment this adjusting means comprises screw 30 threaded through base 11 so as to contact lever 20 at a point 31 displaced from axis A. Screw 30 is preferably an accurate fine pitch screw having a relatively large diameter head 32 to facilitate precision advancement of screw 30. In order to obtain a high degree of overall accuracy in the operation of tramming fixture 10, lever 20 is preferably provided with an anvil 34 having a smooth, hard, flat surface 36 for contact with end 38 of screw 30. End 38 is also preferably smooth and hard and may be rounded or flat as desired. It will thus be apparent that advancing screw 30 toward lever 20 results in contact between anvil surface 36 and screw end 38 with consequent pivotal movement of lever 20 about axis A.

Tramming fixture 10 is further provided with an indicating means associated with lever 20 which is responsive to rotational movement of lever 20 about axis A. In the preferred embodiment this indicating means comprises a sensitive dial micrometer 40 which, as best seen in FIG. 1, is provided with a plunger 42 extending through base 11 and located to contact lever 20 at a point 43 displaced from axis A. Again to facilitate overall accuracy, lever 20 is preferably provided with a second anvil 44 having a smooth, hard, flat surface 46 for contact with end 48, rounded or flat as desired, of plunger 42. Micrometer 40 is mounted on base 11 by means of screw 50 extending through flange 52 of micrometer 40 and spacer 54, screw 50 being threaded into base 11. In operation, as screw 30 is advanced to rotate lever 20 about axis A anvil 44 bears against and depresses plunger 42 so that micrometer 40 provides a reading representative of the movement of lever 20.

Tramming fixture 10 has suitable means to bias lever 20 toward screw 30, such as spring 56 connected to lever 20 and base 11. The bias means may also comprise plunger 42 of micrometer 40 or it may simply comprise the weight of lever 20.

Tramming fixture 10 is additionally provided with contacting means, such as contact wheel 60, associated with lever 20 and adapted to come into contact with a dressing wheel 90 when lever 20 is rotationally moved clockwise by screw 30. As best seen in FIGS. 1 and 2, contact wheel 60 is preferably cylindrical in shape, having a smooth peripheral surface 64 and a mounting hub 66. To facilitate mounting contact wheel 60, lever 20 is provided with an opening 68 extending therethrough from side 70 to side 71 and being of sufficient size to accommodate contact wheel 60. Centers or needle bearings 72, 73 extend through respective ribs 74, 75 such that respective conical points 76, 77 of needle bearings 72, 73 are positioned within opening 68 on a common axis B. Mounting hub 66 of contact wheel 60 is provided with an opening 78 extending therethrough and having generally conical recesses 80, 81 for receiving points 76, 77 of needle bearings 72, 73. Contact wheel 60 is thus concentrically mounted on needle bearings 72, 73 for rotation about axis B. Needle bearings 72, 73 are positioned laterally such that contact wheel 60 is permitted to rotate freely about axis B and may be retained in place in any suitable manner, such as by press fit or retaining caps. An appropriate lubrication may be provided within opening 78 to enhance freedom of rotation. As shown, axis B is displaced from and preferably parallel to, axis A. In operation, as screw 30 is advanced to rotate lever 20 in the clockwise direction about axis A, the peripheral surface 64 of contact wheel 60 provides a surface which will abut against a particular object such as dressing wheel 90. Micrometer 40 will then provide a reading representative of the movement of lever 20, and therefore contact wheel 60, between an initial position and its position at the point of contact between contact wheel 60 and dressing wheel 90. Peripheral surface 64 of contact wheel 60 is preferably precision ground and hardened to facilitate accurate measurement and to avoid excessive wear and marring by contact with dressing wheel 90.

It will be readily apparent that the various elements of tramming fixture 10 can be arranged or constructed in other ways to accomplish the same result. For example, screw 30 and micrometer 40 are shown located on a common side of lever 20 being separated by axis A. Screw 30 and micrometer 40 could be located on opposite sides of lever 20 and displaced in the same direction from axis A. Different types of indicating and adjusting means could be employed. The position of contact wheel 60 can also be varied. The distances between the respective elements can also be changed to obtain the desired measurement sensitivity. For instance, if the distance between screw 30 and axis A is twice the distance between screw 30 and axis B, point 31 of lever 20 will move approximately twice as far as a comparable point on contact wheel 60. More rotation of head 32 is required to move contact wheel 60 a given distance than would be necessary if screw 30 were closer to axis A. Thus the adjustment is more sensitive. Further, if necessary due to space limitations or other reasons, the distances between axis A and one or both of screw 30 and micrometer 40 may be less than or equal to the distance between axis A and axis B. The use of tramming fixture 10 is discussed in detail below.

A typical grinding wheel form-dressing operation is illustrated in FIG. 4 in order to provide a more thorough understanding of the benefits of the instant invention. A portion of a typical grinding wheel 90 is shown in dressing relationship with a portion of a typical grinding wheel 95. Dressing wheel 90 is circular in shape having substantially parallel sides 91, 92 which taper towards a circumferential rounded apex 93. While the term "apex" generally refers to the point at the crown, for the purposes of this invention the term "apex" is taken to include the rounded surface on either side of the crown. During a dressing operation, dressing wheel 90 will be moved around the contour of grinding wheel 95 such that some point on rounded apex 93 is constantly in contact with surface 96 of grinding wheel 95. Apex 93 of dressing wheel 90 is preferably formed such that the rounded surface of the apex lying in a given diametral plane of dressing wheel 90 at the point of contact is defined by a transverse radius having a center C. The size of this radius can vary depending upon the particular application; however, for certain grinding wheels having small, internal radii on its contour a dressing wheel may be required having a transverse radius which is very small (for example 0.005 in.).

An accurately dressed grinding wheel surface 96 is obtained by moving center C of the transverse radius about the contour of the grinding wheel such that center C is maintained a constant distance from surface 96 as by following the path D shown in phantom in FIG. 4. As center C is moved along path D it is necessary to insure that all points on the surface of dressing wheel 90 which contact surface 96 during the dressing operation are equi-distant from center C in order to obtain accurate dressing of surface 96. This is best accomplished by providing dressing wheel 90 with a rounded apex 93 having a transverse radial surface centered at C. As center C is moved along path D dressing wheel 90 will be rotated about center C so as to attain a position such as that shown in phantom in FIG. 4. So long as the point on the surface of dressing wheel in contact with surface 96 lies on the radial surface of apex 93 the distance between center C and the point of contact will remain constant. Thus, as center C is moved along path D dressing wheel 90 must be rotated about center C to the degree necessary to insure that the point on dressing wheel 90 which is in contact with surface 96 lies on the radial surface of apex 93. While dressing wheel 90 is shown in FIG. 4 in positions which are generally perpendicular to surface 96 at the point of contact, such orientation is not required so long as the point of contact lies on the radial surface of apex 93.

A typical dressing machine (not shown) is provided with a dressing wheel fixture, such as that partially shown at 100 in FIG. 3, in which the dressing wheel is concentrically mounted for rotation about its central axis. The dressing wheel fixture is adapted to rotate about an axis Z (as shown in FIGS. 1 and 3), which will be referred to as the dressing axis, and is also adapted to move this axis along a predetermined path defined by a template or an N/C program. The dressing machine is set up so that this dressing axis is proximate to the surface of the grinding wheel to be dressed and is movable about the contour of this surface such that the distance between the surface and the dressing axis is maintained constant. For example, the dressing machine may be set up so that the dressing axis follows the path D shown in FIG. 4. It is thus apparent that the dressing wheel must be positioned in the dressing wheel fixture such that the center C of the transverse radius of the circumferential apex of dressing wheel 90 lies on the dressing axis of the dressing machine. The instant invention provides a method and apparatus for insuring that the dressing wheel is trammed-in, or positioned, such that the center of the transverse radius lies on the dressing axis.

FIG. 5 shows an enlarged view of apex 93 of dressing wheel 90 lying in a diametral plane at the point of dressing contact. The dressing wheel is shown in the trammed-in position in which the center C of transverse radius R, lying in a plane formed by perpendicular X and Y axes, lies on dressing axis Z which is perpendicular to the X-Y plane. When dressing wheel 90 is rotated about dressing axis Z within angular limits determined by the extent of the radial surface of apex 93 in a manner which may occur during a dressing operation the distance $d_0$ between a reference line 105 parallel to the Y-axis and the point P on apex 93 closest to line 105 will always be the same. Thus, assuming that apex 93 has an accurate radius R, it is possible to determine whether dressing wheel 90 is trammed-in by taking respective measurements representative of the distance $d_0$ when dressing wheel 90 is in the position shown in solid lines, when rotated about axis Z through an angle $\alpha$ to the position shown in phantom, and when rotated through an angle $-\alpha$ to the position shown in dashed lines. If these measurements are equal dressing wheel 90 is properly trammed-in.

The tramming method using tramming fixture 10 will now be discussed in more detail. FIG. 6 shows dressing wheel 90 in a typical position prior to tramming-in in which the center C of transverse radius R of apex 93 lying in the X-Y plane is displaced from dressing axis Z. Center C will typically lie on the diametral axis E of dressing wheel 90 and dressing wheel 90 may be initially oriented such that axis E lies in the X-Y plane substantially parallel to the X-axis. It will be seen that center C must be moved in the X-direction and the Y-direction so that center C lies on axis Z. In order to determine how much center C must be moved in the Y-direction so that it lies on the X-axis, dressing wheel 90 is first rotated clockwise through known angle $\alpha$ about the dressing axis Z. A measurement is then taken representative of the distance $d_1$ between reference line 105 and a point $P_1$ which is the point on apex 93 closest to reference line 105. Next, dressing wheel 90 is rotated counterclockwise about dressing axis Z so that axis E forms a known angle which is preferably an angle $-\alpha$ with the X-axis. A measurement is then taken which is representative of the distance $d_2$ between reference line 105 and a point $P_2$ on the surface of apex 93 closest to reference surface 105. Using the difference between the measurements representative of distance $d_1$ and $d_2$, a calculation can be made to determine how much center C must be moved in the Y-direction so that it lies on the X-axis. The amount of movement required can be found from the following formula in which $\Delta Y$ equals the distance center C must be moved in the Y-direction: $\Delta Y=(d_1-d_2)/2 \sin \alpha$. The required movement of the dressing wheel 90 can be made by appropriate adjustments of the dressing fixture, such as by an adjustment of a cross-slide in the Y-direction. If the amount of adjustment required is small it may be possible to position center C within acceptable tolerances simply by taking one half of the difference ($\Delta Y=(d_1-d_2)/2$).

Once this adjustment is made, dressing wheel 90 will be in the position shown in FIG. 7 in which center C lies substantially on the X-axis but is still displaced from the Y-axis. In order to determine the amount the center C must be moved in the X direction, the dressing wheel 90 may first be oriented such that its diametral axis E coincides with the X-axis. A measurement is then taken which is representative of the distance $d_3$ between reference line 105 and the point $P_3$ lying on apex 93 and being closest to reference line 105. Dressing wheel 90 is then rotated clockwise through a known angle $\alpha$ about dressing axis E. A measurement is then taken which is representative of the distance $d_4$ between reference line 105 and the point $P_4$ on apex 93 closest to reference line 105. The difference of the measurements representative of distances $d_3$ and $d_4$ is then used in a calculation to determine the amount center C must be moved in the X-direction. This can be determined from the following formula in which $\Delta X$ equals the amount center C must be moved in the X direction: $\Delta X=(d_3-d_4)/(1-\cos \alpha)$. Appropriate adjustments of the dressing fixture, such as by moving a cross-slide in the X-direction, can then be made to move center C so that it lies substantially on the Y axis. Dressing wheel 90 will now be in the trammed-in position in which center C lies substantially on the dressing axis Z, the position shown in FIG. 5.

It will be noted that in the foregoing description the dressing wheel 90 was initially oriented such that diametral axis E was parallel to the X-axis in the methods for determining $\Delta X$ and $\Delta Y$. This is done for convenience in describing the method, but is not necessarily required. In determining $\Delta Y$ it is only necessary to take measurements when axis E forms known angles, which are preferably angles $\alpha$ and $-\alpha$, with the X-axis, dressing wheel 90 being rotated about dressing axis Z between these two angles. In the case of $\Delta X$, the dressing wheel 90 could initially be oriented so that axis E forms an angle $\alpha$ (or $-\alpha$ if convenient) with the x-axis for the first measurement. Dressing wheel 90 can then be rotated about the dressing axis Z such that axis E coincides with the x-axis so that the second measurement can be taken. Thus, it is apparent that the important factor is to obtain measurements for known orientations of dressing wheel 90 which permit determination of the position adjustments required to accurately locate the center C of transverse radius R.

Tramming fixture 10 can be used in the following manner to make the foregoing measurements under either static or dynamic conditions. Tramming fixture 10 is typically mounted on the dressing machine in any suitable manner by means of flange 12 such that contact wheel 60 is located proximate to the dressing axis Z and lever 20 is oriented substantially parallel to dressing axis Z, as best seen in FIG. 1. Assuming that dressing wheel 90 is located in dressing fixture 100 with center C of the transverse radius in the position shown in FIG. 6, dressing fixture 100 is initially oriented such that dressing wheel 90 rotates in a plane containing diametral axis E substantially perpendicular to the Y-axis and axis Z, as shown in FIGS. 1 and 3. Contact wheel 60 preferably rotates in a similar parallel plane so that peripheral surface 64 is substantially perpendicular to diametral axis E at the point of contact with apex 93. In use, surface 64 of contact wheel 60 corresponds to reference line 105 in FIGS. 5–7 when contact wheel 60 is in an initial position some distance from apex 93 of dressing wheel 90.

With dressing fixture 100 and dressing wheel 90 oriented as shown in FIG. 3, the tramming procedure is initiated. Initially, screw 30 is adjusted so that contact wheel 60 is proximate to but not contacting the circumferential apex 93 of dressing wheel 90. Dressing fixture 100 is then rotated clockwise through an angle $\alpha$ about axis Z so that dressing wheel 90 is also rotated clockwise through an angle $\alpha$ about dressing axis Z in a manner as shown in FIG. 6 and previously described. Screw 30 is then advanced until contact is made between apex 93 of dressing wheel 90 and surface 64 of contact wheel 60. When tramming is done under dynamic conditions with dressing wheel 90 rotating about its center, contact may be visually detected by observing when contact wheel 60 begins to rotate in response to contact with rotating dressing wheel 90. At this point advancement of screw 30 is stopped and a reading is taken from micrometer 40 which is representative of the distance moved by contact wheel 60. Screw 30 is then retracted so that contact wheel 60 moves out of contact with dressing wheel 90.

Dressing fixture 100 is then moved in the opposite direction such that dressing wheel 90 rotates about dressing axis Z so that axis E forms an angle $-\alpha$ with the X-axis as shown in dotted lines in FIG. 6. Dressing wheel 90 and dressing fixture 100 thus assume the position shown in phantom in FIG. 3. Screw 30 is then advanced until contact is made between dressing wheel 90 and contact wheel 60 and a measurement is taken as previously described. These measurements can then be used in the manner previously discussed to determine how much center C must be moved in the Y-direction to locate center C on the X-axis. When center C is properly located with respect to the X-axis, tramming fixture 10 can be used in a similar manner to obtain measurements in accordance with the foregoing method useful in locating center C on the Y-axis.

Thus the invention provides a method for accurate location on the dressing axis Z of center C of the transverse radius of apex 93 when center C is offset from dressing axis Z in one or both of the X and Y directions. Further, the method can be used to simply determine the amount of offset.

Tramming fixture 10 is preferably so constructed that there is a known relationship between the readings obtained from micrometer 30 and distances moved by contact wheel 60. For instance, micrometer 40 preferably provides distance readings equal to the distance traveled by contact wheel 60. Readings could also correspond to some known multiple or fraction of the distance traveled by contact wheel 60. If there is a direct one-to-one relationship between the micrometer readings and the distance traveled by contact wheel 60, the difference of the two readings will equal the difference between $d_1$ and $d_2$ in FIG. 6. If, for example, the relationship is two-to-one, the difference between the readings must be divided by 2 to get $d_1-d_2$. Thus, these two readings can be used to determine $\Delta Y$ in the manner previously described. Dressing fixture 100 can then be appropriately adjusted to move center C in the Y-direction so that it lies substantially on the X-axis. Tramming fixture 10 can then be used in a similar manner to take measurements necessary to determine the required movement of center C in the X-direction as discussed with respect to FIG. 7.

Tramming fixture 10 can be so constructed that it is capable of locating center C on the dressing axis E within very fine tolerances, such as within $\pm 0.001$ inches. The use of precision bearing arrangements, highly sensitive indicating means, and adjusting means, and appropriate relationships between distances of the elements from axis A can all be employed to accomplish this end.

It will be apparent to those skilled in the art that various modifications can be made to the preferred embodiment of the tramming fixture of the invention as well as to the orientation of the various elements in performing the method of the invention without departing from the scope and spirit thereof. Consequently, the particular embodiments disclosed are to be considered exemplary only and the invention is to be limited solely by the claims.

I claim:

1. A tramming fixture for use in accurately positioning a dressing wheel in a dressing wheel fixture of a grinding wheel dressing machine such that the center of the transverse radius of the circumferential apex of the dressing wheel at the point of dressing contact lies on a dressing axis about which the dressing wheel may be rotated by the dressing wheel fixture, said dressing axis being maintained a predetermined distance from the grinding wheel surface being dressed, said tramming fixture comprising: a fixed support base; a lever mounted on said base by rotation about an axis of said lever, said axis being fixed with respect to said base; means for selectively adjusting the position of said lever through rotational movement of the lever; means for indicating the rotational movement of said lever; and a contact surface means associated with said lever and displaced from said lever axis to contact said dressing wheel at a point on said apex when moved towards said dressing wheel through movement of said lever by said adjusting means, whereby said indicating means provides a reading indicative of relative dressing wheel position.

2. A tramming fixture according to claim 1 wherein said contact surface means comprises a contact wheel supported on said lever for rotation about the axis of said contact wheel.

3. A tramming fixture according to claim 2 wherein said contact wheel axis is substantially parallel to said lever axis.

4. A tramming fixture according to claim 3 wherein said contact wheel axis and said lever axis lie in a common plane.

5. A tramming fixture according to claim 1 wherein said adjusting means is located to contact said lever at a point displaced from said lever axis and produce rotational lever movement through movement of a portion of said adjusting means in contact with said lever.

6. A tramming fixture according to claim 5 wherein the distance between the lever contact point of said adjusting means and said lever axis is greater than the distance between said lever axis and said contact surface means.

7. A tramming fixture according to claim 5 wherein said adjusting means comprises a screw threaded through said base and having a free end in contact with said lever, said lever movable about said lever axis in response to rotation of said screw.

8. A tramming fixture according to claim 5 additionally comprising means for biasing said lever toward said adjusting means.

9. A tramming fixture according to claim 8 wherein said biasing means comprises said indicating means.

10. A tramming fixture according to claim 1 wherein said indicating means is located to contact said lever at a point displaced from said lever axis and produce an indication of movement through movement of a portion of said indicating means in contact with said lever.

11. A tramming fixture according to claim 10 wherein the distance between the lever contact point of said indicating means and said lever axis is greater than the distance between said lever axis and said contact surface means.

12. A tramming fixture according to claim 10 wherein said indicating means comprises a micrometer mounted on said base, said micrometer having a plunger which comprises said indicating means portion.

13. A tramming fixture according to claim 10 wherein said adjusting means is located to contact said lever at a point displaced from said lever axis and produce rotational lever movement through movement of a portion of said adjusting means in contact with said lever, said adjusting means and said indicating means being located to contact said lever at respective points displaced from said lever axis on a common side of said lever.

14. A tramming fixture according to claim 13 wherein said respective points are separated by said lever axis.

* * * * *